US006130193A

United States Patent [19]

Gillette

[11] Patent Number: 6,130,193

[45] Date of Patent: Oct. 10, 2000

[54] LAUNDRY DETERGENT COMPOSITIONS CONTAINING SILICA FOR LAUNDRY DETERGENT SHEETS

[75] Inventor: Samuel Mark Gillette, Burlington, N.C.

[73] Assignee: Precision Fabrics Group, Inc., Greensboro, N.C.

[21] Appl. No.: 09/019,606

[22] Filed: Feb. 6, 1998

[51] Int. Cl.[7] ..... C11D 1/02; C11D 1/66; C11D 1/94; C11D 3/08

[52] U.S. Cl. ..... 510/295; 510/320; 510/321; 510/324; 510/325; 510/327; 510/328; 510/336; 510/337; 510/338; 510/350; 510/351; 510/356; 510/357; 510/438; 510/511

[58] Field of Search ..... 510/292, 295, 510/320, 321, 324, 325, 327, 328, 336, 337, 438, 511, 350, 351, 356, 357, 338

[56] References Cited

U.S. PATENT DOCUMENTS

| | | | |
|---|---|---|---|
| Re. 33,646 | 7/1991 | Klemm et al. | 510/277 |
| 3,703,772 | 11/1972 | McHugh et al. | 34/341 |
| 3,893,840 | 7/1975 | Wason | 106/492 |
| 3,925,224 | 12/1975 | Winston | 8/137 |
| 3,933,672 | 1/1976 | Bartolotta et al. | 510/438 |
| 3,936,537 | 2/1976 | Baskerville, Jr. et al. | 510/330 |
| 4,058,489 | 11/1977 | Hellsten | 510/329 |
| 4,062,647 | 12/1977 | Storm et al. | 8/137 |
| 4,067,746 | 1/1978 | Wason et al. | 106/492 |
| 4,073,996 | 2/1978 | Bedenk et al. | 428/274 |
| 4,115,292 | 9/1978 | Richardson et al. | 510/392 |
| 4,118,327 | 10/1978 | Seugnet | 510/521 |
| 4,132,806 | 1/1979 | Wason | 514/770 |
| 4,156,717 | 5/1979 | Wason | 424/49 |
| 4,170,565 | 10/1979 | Flesher et al. | 510/297 |
| 4,199,464 | 4/1980 | Cambre | 510/295 |
| 4,199,465 | 4/1980 | Rodriguez | 510/295 |
| 4,255,294 | 3/1981 | Rudy et al. | 510/331 |
| 4,321,157 | 3/1982 | Harris et al. | 510/348 |
| 4,375,416 | 3/1983 | Crisp et al. | 510/332 |
| 4,421,792 | 12/1983 | Rudy et al. | 427/242 |
| 4,561,993 | 12/1985 | Choy et al. | 510/397 |
| 4,589,989 | 5/1986 | Müller et al. | 510/515 |
| 4,615,814 | 10/1986 | Winetzky | 510/308 |
| 4,792,487 | 12/1988 | Schubring et al. | 428/342 |
| 4,861,502 | 8/1989 | Caswell | 510/299 |
| 4,876,023 | 10/1989 | Dickenson et al. | 510/296 |
| 4,886,615 | 12/1989 | Dehan | 510/296 |
| 4,891,143 | 1/1990 | Woodward et al. | 510/321 |
| 4,911,851 | 3/1990 | Ladd, Jr. et al. | 510/297 |
| 4,915,854 | 4/1990 | Mao et al. | 510/296 |
| 4,931,200 | 6/1990 | Shanklin et al. | 510/295 |
| 4,942,410 | 7/1990 | Fitch et al. | 346/160.1 |
| 4,954,285 | 9/1990 | Wierenga et al. | 510/101 |
| 5,002,681 | 3/1991 | Wierenga et al. | 510/297 |
| 5,019,280 | 5/1991 | Caswell et al. | 510/328 |
| 5,196,139 | 3/1993 | Moschner | 252/186.25 |
| 5,258,141 | 11/1993 | Crump et al. | 510/434 |
| 5,264,142 | 11/1993 | Hessel et al. | 510/303 |
| 5,358,647 | 10/1994 | Puentes-Bravo et al. | 510/328 |
| 5,362,412 | 11/1994 | Hartman et al. | 510/318 |
| 5,362,541 | 11/1994 | Sextl et al. | 428/69 |
| 5,472,455 | 12/1995 | Mehreteab et al. | 8/137 |
| 5,494,488 | 2/1996 | Arnoldi et al. | 510/292 |
| 5,494,599 | 2/1996 | Goovaerts et al. | 510/443 |
| 5,496,486 | 3/1996 | Staley | 510/441 |
| 5,501,814 | 3/1996 | Engelskirchen et al. | 510/471 |
| 5,510,042 | 4/1996 | Hartman et al. | 510/515 |
| 5,518,645 | 5/1996 | Beaujean et al. | 510/372 |
| 5,545,352 | 8/1996 | Pike | 510/514 |
| 5,616,277 | 4/1997 | Raleigh et al. | 510/220 |
| 5,622,925 | 4/1997 | de Buzzaccarini et al. | 510/329 |
| 5,635,467 | 6/1997 | Staley | 510/349 |
| 5,646,101 | 7/1997 | MacBeath | 510/220 |
| 5,654,265 | 8/1997 | Kuroda et al. | 510/507 |

FOREIGN PATENT DOCUMENTS

| | | |
|---|---|---|
| 818 419 | 7/1969 | Canada . |
| 0332260 | 9/1989 | European Pat. Off. . |
| 247807 | 7/1987 | German Dem. Rep. . |

OTHER PUBLICATIONS

*McCutcheon's Emulsifiers & Detergents,* vol. 1; McCutcheon's Division, MC Publishing Company, 1995. p. 67. TP990.D4v.1. No Month Available.

Raymond Getty et al., "Silicates as Corrosion Inhibitors in Synthetic Detergent Mixtures", *ASTM Bulletin,* No. 205, pp. 3–12 (Apr. 1955).

PQ Sodium Silicates: Liquids & Solids, Versatile Products, Versatile Applications, *The PQ Corporation.* (1994) No Month Available.

Database WPI, Week 8038, Derwent Publications Ltd., London, GB; AN 66784, XP002087587 & JP 55 102696 A (Johnson KK), Aug. 6, 1980.

*Primary Examiner*—Gregory R. Del Cotto

*Attorney, Agent, or Firm*—Finnegan, Henderson, Farabow, Garrett & Dunner, L.L.P.

[57] ABSTRACT

A laundry sheet is disclosed which is a substrate having a detergent composition applied thereto. The detergent composition contains a water insoluble silica gel to produce a laundry sheet having a dry hand. The laundry sheet provides a total laundering process that cleans and softens.

17 Claims, No Drawings

LAUNDRY DETERGENT COMPOSITIONS CONTAINING SILICA FOR LAUNDRY DETERGENT SHEETS

BACKGROUND OF THE INVENTION

The present invention relates to laundry products. More particularly, the present invention relates to compositions for laundry use and laundry sheets containing these compositions.

Laundry detergents are commonly dispensed into washing machines by measuring various amounts of liquid or powder detergents into cups or other measuring devices. This is inconvenient, and the consumer's time is wasted by measuring the correct amount of detergent for each load of laundry. Furthermore, when liquid or powder detergents are measured out into cups or other measuring devices, there exists a common problem of spillage of detergents around the washing machine.

Attempts have been made to develop acceptable laundry products having a detergent composition impregnated onto a soluble or insoluble fabric sheet. These laundry products desirably are dry to the touch, or in other words, have a "dry hand." At the same time, however, these products should have sufficient detergency, antistatic, and fabric softening properties, while also having a structure and composition simple enough to allow for simple and efficient production of the laundry product.

Other attempts to overcome the disadvantages of measuring out detergents include the use of a detergent pouch which is held together with a water soluble adhesive. These products avoid the necessity for a dry hand by placing little or no components of the detergent composition on the outside surfaces of the pouch. In theory, the pouch becomes unglued in the wash water and releases detergent chemicals into the washing machine. However, the detergent chemicals in the pouch sometimes form clumps which do not break or solubilize to release detergent into the wash water. Also, residual detergent chemicals may remain on the clothes if the detergent in the pouch forms insoluble clumps.

U.S. Pat. No. 3,703,772 discloses heat-sensitive organic detergents, which may contain powdered silica to decrease decomposition of the detergents' components by improving drying rates needed to produce a dry product.

U.S. Pat. No. 4,199,464 discloses substrate articles containing mixtures of cationic and nonionic surfactants, which also may contain silica to minimize the bleeding characteristics of the product during storage.

U.S. Pat. No. 5,635,467 discloses free flowing granular detergent compositions which contain "barrier materials" such as amorphous silica, silicon dioxide, crystalline-free silicon dioxide, and/or synthetic amorphous silicon dioxide hydrate. According to the '467 patent, the "barrier materials" isolate surfactant laden builder particles from adjacent surfactant laden particles to prevent further agglomeration or coalescence.

Accordingly, there is a need for a detergent composition that may be easily produced, and also applied to a substrate to form a laundry sheet. Also, there is a need for a laundry sheet having a dry hand that is acceptable to the consumer market, yet having sufficient detergent and/or fabric softening properties to serve as an effective laundry product. There is also a need for laundry sheet products that are relatively simple to manufacture.

SUMMARY OF THE INVENTION

An object of the present invention is to provide a detergent composition that is easily processed.

Another object of the present invention is to provide a laundry sheet having a dry hand.

Another object of the present invention is to provide a laundry sheet having effective detergent properties.

Another object of the present invention is to provide a laundry sheet having a dry hand which has both detergent and fabric softening properties.

Another object of the present invention is to provide a laundry sheet containing a predetermined amount of a laundry detergent and an antistatic agent or fabric softener which will permit the consumer to simply add the laundry sheet to the washing machine and add additional sheets for larger loads or for loads that the consumer expects will be difficult to clean into the washing machine.

Another object of the present invention is to provide a laundry sheet that allows dissolution or dispersion of the laundry detergent chemicals off of the sheet within the first two minutes in the wash water and that does not allow insoluble or undispersed macroscopic detergent chemical particles to remain in the washing machine at the end of the wash cycle.

Another object of the present invention is to provide an environmentally friendly detergent system which will preferably avoid the use of powdered detergents that incorporate increased quantities of fillers to make them flowable.

Another object of the present invention is to provide a laundry sheet that preferably can be recycled and which avoids the use of fillers that must be processed by waste treatment plants and landfills.

Additional advantages of the present invention will be set forth in part in the description which follows, and in part will be apparent from the description, or may be learned by the practice of the present invention.

To achieve these and other advantages and in accordance with the purpose of the present invention, as embodied and broadly described herein, the present invention relates to a detergent composition containing, on a dry basis, about 0.5 to about 30 weight percent of water insoluble silica gel; about 5 to about 95 weight percent of a surfactant; and about 0 to about 60 weight percent of a builder.

The present invention also relates to a laundry sheet containing, on a dry basis, a composition containing about 0.5 to about 30 weight percent of water insoluble silica; about 5 to about 95 weight percent of a surfactant; and about 0 to about 60 weight percent of a builder.

The present invention also relates to a method of making a laundry sheet, wherein the method includes applying to a substrate a composition containing about 0.5 to about 30 weight percent of water insoluble silica; about 5 to about 95 weight percent of a surfactant; and about 0 to about 60 weight percent of a builder; and allowing the composition to dry.

It is to be understood that both the foregoing general description and the following detailed description are exemplary and explanatory only and are not restrictive of the present invention, as claimed.

DETAILED DESCRIPTION OF THE INVENTION

The present invention addresses several problems experienced in the prior art by using a water insoluble silica gel in a composition which may be formulated for application on to a substrate to form a laundry sheet. As mentioned, the composition acts as a detergent so that once deposited on a substrate to form the laundry sheet, the consumer may use the laundry sheet to add a predetermined amount or dose of the composition to a laundry cycle. The laundry sheet therefore eliminates the need for the consumer to measure an amount of either a liquid or powder detergent composition to be added to the wash. This added convenience provided by the laundry sheet saves time and avoids a potentially messy step for the consumer.

While not wishing to be bound by a particular theory, it is believed that the water insoluble silica gel used in the composition allows the use of several components in the composition to provide cleaning power, where those components would otherwise cause the laundry sheet to have a wet hand which would be undesirable to the consumer. The laundry sheet may therefore be formed of a single or multi-ply sheet, having at least one component of the detergent composition on an outside surface of the laundry sheets. When the silica gel is also present on the outside surface, the outside surface may also contain a detergent component which would otherwise cause the sheet to feel wet or greasy.

For example, certain nonionic surfactants may cause a final laundry sheet product to have a wet hand. When used in combination with the silica gel in the composition, however, the laundry sheet product has a drier hand therefore making it more acceptable to the consumer.

The water insoluble silica gel may allow uncomplicated processing steps to form the composition and a laundry sheet product. Again, not wishing to be bound by a specific theory, the silica gel may allow the composition to be processed under conditions that are economically feasible. When forming a composition either from an aqueous slurry or a melt, it was found that increasing the quantity of absorbent materials to levels needed to adsorb surfactants present and provide a dry hand led to undesirable increases in the melt's viscosity. This increased viscosity resulted in a melt that was difficult to process. Compositions containing silica gel, however, had a viscosity low enough to facilitate processes at an acceptably low temperature. For example, a melt containing silica gel had a viscosity below about 12,000 centipoise at about 40° C. or less while still producing a product having a dry hand. The processing temperature, in turn, was low enough to provide for the effective incorporation of temperature-sensitive components in the composition. Examples of such temperature- sensitive components include enzymes, bleaches, and bleach activators.

One embodiment of the present invention therefore relates to the use of a water insoluble silica gel in the composition that is deposited on to a substrate to form the laundry sheet. The silica gel is preferably substantially pure $SiO_2$, and more perferably contains above about 99 weight percent $SiO_2$. The silica gel preferably has impurities of less than about 1 weight percent soda as $NaO_2$ and less than about 1 weight percent sulfate as $SO_4$. The silica gel is insoluble in water at pH values less than 9.

Preferably, the silica gel used has a pore volume, measured by the nitrogen BET method, of about 0.3 to about 2.5 cc/g. More preferably, the pore volume is about 1.5 to about 2.5 cc/g. The silica gel also has a preferred surface area of about 150 to about 900 $m^2/g$, more preferably about 150 to about 450 $m^2/g$, and most preferably about 225 to about 360 $m^2/g$. Preferred silica gels have an internal porosity for liquid uptake, as measured by oil absorption, of about 100 to about 350 pounds of oil per 100 pounds of silica gel. More preferably, the internal porosity of the silica gel ranges from about 200 to about 350 pounds of oil per 100 pounds of silica gel, most preferably about 270 to about 330 pounds of oil per 100 pounds of silica gel.

The silica gel described herein is a coherent, rigid and porous three dimensional sponge-like network formed by a polymerization/aggregation process. Silica gel is an amorphous synthetic silica which has a higher shear resistance than either precipitated or fumed silicas. The resistance to shear afforded by silica gel allows a composition containing silica gel to be stirred vigorously without dramatically increasing its viscosity. Precipitated and fumed silicas, however, are easily broken down with shear, thus destroying their inherent porosity and resulting in an undesirably high increase in viscosity. Similarly, colloidal silicas offer minimal oil absorption relative to their thickening effect.

The silica gel used in the composition may be prepared by washing a sodium silicate with a mineral acid and allowing the silanol groups on the surface of the silicate particles to polymerize to siloxane bonds. Thus, a three dimensional network is formed by this polymerization process, and the network entrains the water medium giving a rigid, gel-like material from which the name silica gel is derived. After the silica gel has formed into a large sponge-like mass it is broken down into small pieces and then milled to achieve micron sized particles with a high porosity. The size of the silica may range from 3 to about 20 microns, preferably about 3 to about 5 microns.

When the composition is intended for use as a detergent without a substrate, preferred silica gels that may be used in the composition are sold by Grace Davison under the trade names SYLOID and SYLOJET. When the composition is intended to be applied to a substrate to form a laundry sheet, the composition may contain synthetic, silica gels such as SYLOID, SYLOX, and SYLOJET silica gels. Even more preferably, the silica gels used include those from the SYLOID 800 series, and the SYLOJET P 400 series.

The silica gel is present on a dry basis in the composition in an amount effective to impart a dry hand to the laundry sheet. A preferred amount of the silica gel present may range from about 0.5 to about 30 wt %. More preferably, the silica gel is present in the composition from about 1.5 to about 10 wt %.

The silica gel is preferably present in the detergent composition, and on the laundry sheet, as a particulate in intimate admixture with a solid, water-soluble ionizable material. These materials may act as builders, and may also be added to the composition to increase the solubility. Examples of solid, water-soluble materials include organic acids, organic and inorganic acid salts and mixtures thereof.

The composition may also contain components to provide cleaning, whitening, brightening, and freshening to laundered textiles. Preferably, the composition includes at least a primary surfactant that has good detergency in all temperatures of wash water and in all water hardness conditions, such as a nonionic surfactant. When applied to a substrate to produce a laundry sheet for consumer use, the combination of surfactants and other materials used should preferably dry down to a coating which adheres to the substrate and does not flake off or rub off. Also, surfactants which have a dry finish upon drying on the substrate are preferred over those that leave a wet finish.

It is preferred that besides the primary surfactant, one or more nonionic surfactants such as alcohol ethoxylates can also be included. Four preferred nonionic surfactants are linear primary $C_{12}$–$C_{15}$ alcohol 9-nonylethoxylate, e.g., NEODOL 25-9 (Shell Chemical Co.), $C_{11}$–$C_{15}$ secondary alcohol ethoxylate, e.g., TERGITOL 15-S-9 (Union Carbide), alkyl polyglycosides such as GLUCAPON 225 (Henkel) and ethylene oxide/propylene oxide block copolymers such as PLURONIC F77 (BASF). Other nonionic surfactants that may be used include, but are not limited to other alcohol ethoxylates such as SURFONIC L-24-9 (Texaco Chemical Co.), also known as $C_{12}$–$C_{14}$-pareth-8.2, SURFONIC N-95 (Texaco Chemical Co.), also known as nonoxynol-10, IGEPAL CO-630 (Rhone-Poulenc), also known as nonoxynol-9. NEODOL 25-9 is preferred of all of these nonionic surfactants because of its good biodegradability.

Generally, the amount of the primary surfactant included is an amount that is sufficient to remove the soil and stains from clothing. A preferred amount is from about 1% to about 80% by weight and more preferably from about 5% to about 40% by weight of the detergent composition. If the acid form of the surfactant is used for economic reasons, generally, enough sodium hydroxide or other base is added to neutralize the acid. Preferably, a 50% sodium hydroxide solution is used in a sufficient amount to neutralize the acid form of the surfactant.

In situations where the primary surfactant by itself or with an optional builder present is not effective due to excessively cold or hard water, additional nonionic, anionic, or amphoteric surfactants can optionally be added to the composition in an amount sufficient to augment the detergency of the primary surfactant(s). Nonionic, anionic, and amphoteric surfactants suitable for this application include, but are not limited to, alcohol ethoxylates, alkyl phenol ethoxylates, ethylene oxide/propylene oxide block copolymers, alkyl polyglycosides, alkanolamides, amine ethoxylates, amine oxides, and the like. A preferred amphoteric surfactant is cocoamphocarboxydipropionate e.g., MONATERIC CEM-38 (Mona Industries).

A preferred primary surfactant that is anionic for purposes of the present invention is alkylated sulfonated diphenyl oxide-disodium salt, commercially available as DOWFAX Detergent Solution (Dow Chemical Co.), which has the ability to dry down to a powder and is suitable for hard water detergency. Another preferred primary surfactant is tetrasodium N-(1,2-dicarboxyethyl)-N-octadecyl sulfosuccinamate, e.g., AEROSOL 22 (Cytec Industries, Inc.).

Another anionic surfactant is a sodium salt of dodecylbenzenesulfonic acid (DDBSA) which may be purchased commercially. Alternatively, the acid form of DDBSA can be neutralized with sodium hydroxide to form the sodium salt of DDBSA. This surfactant is available under the tradename BIO-SOFT S-100 (Stepan Co., Northfield, Ill.) and substitutes include, but are not limited to, CALSOFT LAS-99 (Pilot Chemical Co.), CAROSULF UL-100 (Lonza Inc.), and WITCO 1298 Acid (WITCO Chemical Co.). BIO-SOFT Preblend is a 46% solution of neutralized DDBSA. Other examples include, but are not limited to, sulfates and sulfonates of ethoxylated alcohols, linear alkyl benzene sulfonates, alcohol sulfates, sodium or potassium salts of long chain fatty acids, carboxylic soaps (e.g., $C_{10}$–$C_{22}$ types), secondary alkane sulfonates, α-olefin sulfonates, methylester sulfonates, and the like.

If a nonionic surfactant is also included, generally an amount is added to the composition to permit the overall composition to remove soil and stains sufficiently in cold water. Preferably, from about 0 to about 70%, more preferably from about 1% to about 40%, of one or more of the nonionic surfactants by weight of the composition can be included.

The following additional components can be also included in the composition in any combination. In general, these additional components are builders, complexing agents, optical brighteners, oxidizing agents, alkaline sources, electrolytes, foam stabilizers, fragrances, color enhancers, biocides, corrosion inhibitors, soil anti-redeposition agents, encrustation preventors, oxidizing agents, and enzymes. Any one or more of these components can be present and examples of each of these components are known to those skilled in the art.

With regard to builders and complexing agents, any builder is suitable for use in the composition of the present invention such as borates, phosphates, polyphosphates, silicates, carbonates, citrates, ethylenediamine tetraacetates, nitrilotriacetates, and the like. Sodium alumina silicate zeolites, such as VALFOR 100 (PQ Corporation), may also be used because of their commercial acceptance in the market and availability in small particle sizes. Builders that can be dried down to a solid and/or can remove divalent and/or polyvalent ions from the wash water, especially iron, copper, calcium, and magnesium, are preferred for inclusion in the detergent composition of the present invention. Further, builders that work by chelation, ion exchange, or precipitation are suitable for use in the present invention. Generally, if a builder is included in the detergent composition of the present invention, an effective amount is included to remove a portion of at least one divalent or polyvalent ion from wash water. Preferred amounts of the builder are from about 0% to about 60% by weight of the detergent composition, more preferably from about 10% to about 40% by weight of the detergent formulation.

Another optional component is an optical brightener which can be added to the composition of the present invention. Generally, any optical brightener can be included in the composition. The optical brightener should preferably take ultraviolet light and shift its wavelength to light in the visible spectrum. Further, optical brighteners should not hinder detergency, yellow the fabric, or cause any other negative effects such as odor or health concerns. Preferably, the optical brighteners contain bistriazinylaminostilbene for brightening of cellulosics and an additional optical brightener for brightening lower surface energy synthetics. Optical brighteners which can be used to brighten cellulosics include, but are not limited to, BLANKOPHOR BBH (Burlington Chemical Co.) (fluorescent brightener 113) and TINOPAL 5BM-GX (Ciba Co.) (fluorescent brightener 28). Substitutes for the BLANKOPHOR BBH include PHORWITE BA(Miles Co.) (fluorescent brightener 113) and RYLUX BA (Ostacolor A.S.) (fluorescent brightener 113). Substitutes for TINOPAL 5BM-GX include PHOTINE C (Miles) (fluorescent brightener 28) and VIOPHOS BCU (Viochron S.A.) (fluorescent brightener 28). TINOPAL SWN (fluorescent brightener 140) and BLANKOPHOR SOL (fluorescent brightener 61) can also be used to achieve the brightening of synthetic fibers as well as RANIPAL SWN (Indian Dystuff Ind. Ltd.) (fluorescent brightener 140) and RYLUX BCU (fluorescent brightener 140). Generally, the amount of optical brightener, if included in the detergent formulation, is an effective amount to brighten the washed clothing. Preferably, from about 0.005% to about 5% by weight of the composition can be included.

When the composition is applied to a substrate to form a laundry sheet, the sequential application of the composition in more than one layer may advantageously separate ingredients in the composition that otherwise would degrade each other. For example, proteases are known to degrade other enzymes such as lipases (e.g. LIPOLASE from Novo Nordisk), amylases (e.g. TERMAMYL or DURAMYL also from Novo Nordisk), and cellulases (e.g. CELLUZYME from Novo Nordisk). Thus, proteases (such as SAVINASE or EVERLASE from Novo Nordisk) may be applied to one side of the sheet and other enzymes to the opposite side of the sheet. As another example, bleach activators such as those described in U.S. Pat. No. 4,483,778, the entire contents of which are incorporated herein by reference, may be separated from peroxygen bleaches to prevent premature degradation of the bleach. Types of bleaches that may find utility in this coating include but are not limited to perborates, percabonates, hypohalites, and peroxoic acids.

The enzymes, bleaches, and bleach activators described above are preferably released into the wash at the beginning of the wash cycle. Thus, when making a laundry sheet, these ingredients may be applied to a substrate after the application of other components of the composition. The resulting laundry sheet product would then have these ingredients on either its front or back surface to allow rapid dissolution, to allow the ingredients to be separated from the previously coated detergent chemicals so as to reduce deleterious interactions between the ingredients, and to allow for application using different processes (including the printing of patterns). Application of various components or ingredients as sequential layers on the substrate may also allow drying temperatures to be specifically tailored to the characteristics of each layer.

The ingredients preferably used in outer layers of the laundry sheet may be any ingredients that are known in the art as a detergent chemical or as a detergent auxiliary. For example, polyvinyl pyrrolidone (SOKALAN HP 53 from BASF) which is known to be a dye scavenging and soil antiredeposition agent can be printed onto the surface of this sheet. Also, color may be added to the ingredients of subsequent layers that are printed, gravure coated, kiss coated, knife coated, sprayed or otherwise applied. Furthermore, these subsequent layers may be applied in patterns and logos to produce aesthetically pleasing results and to allow for rapid dissolution of previously applied layers should subsequent coatings be less soluble than earlier coatings. Subsequent layers may also be useful for preventing skin contact with previous layers which contain enzymes.

Other ingredients that may be used in a second or subsequent coating on the detergent sheet include builders, nonionic surfactants, polyethylene glycols, polyethylene oxide/polypropylene oxide block copolymers and all types of soil antiredeposition agents. These ingredients would preferably act as carriers for enzymes in powder or liquid form, enzyme stabilizers, protease inhibitors, bleaches, colorants, bleach activators, thickeners and other process aids. The carrier ingredients would preferably be water soluble, water dispersible or have a melting point between 25° C. and 45° C., more preferably between 30° C. and 40° C. Furthermore, it is desirable that the carrier ingredients contribute to a dry hand on the sheet.

The aforementioned coatings may be applied as aqueous coatings, solvent coatings or as melts which are subsequently cooled. However the coating is applied and however the coating is dried, these processes should not excessively reduce the activity of or degrade the ingredients in the coating. Any coating and drying processes known to those in the art may be used if adequate process controls are maintained. Coating methods used for producing the laundry sheet may involve the use of vacuum extraction, vacuum extraction coupled with heating, and application of the coating in molten form followed by air or contact chilling of the coating for solidification. Various solvents may be used as process aids for this coating. Some suitable solvents include supercritical carbon dioxide, carbon tetrachloride, fluorohydrocarbons, ketones (e.g. acetone and methyl ethyl ketone), ethers (e.g. diethyl ether), and alcohols (e.g. methanol, ethanol, propanol etc.). Many solvents besides those listed are expected to be found suitable for this application.

The next optional component that may be used in the composition is an alkaline source to raise the pH of the wash water. While any alkaline source can be used for this purpose, it is preferred that the alkaline source not contribute any odor to the product and be dry to the hand when applied to a substrate. A preferred alkaline source is sodium carbonate which also increases the detergency of clay soils, fatty acids, and sebum in the composition. Also, sodium silicates, for instance those sold by PQ Corporation and soil antiredeposition polymers such as the sodium salts of polymethacrylate or methacrylatemaleic anhydride copolymers, e.g., ACUSOL products (Rohm & Haas), can also contribute to the pH of the wash water. Generally, a sufficient amount of an alkaline source should be added to raise the pH of the composition to a pH of approximately 9 to about 11.5. Preferably the alkaline source may be present from about 1% to about 60% by weight and more preferably from about 5% to about 20% by weight of the composition.

The next optional component that can be included in the composition is an electrolyte which, if chosen well, can also serve as a builder and pH booster. The sodium carbonate referenced above can also serve as an electrolyte which will lower the critical micelle concentration of many surfactants. The presence of additional electrolytes may also allow the surfactants to emulsify some oils and dirt at lower concentrations. Examples of additional electrolytes are sodium silicate and sodium borate. Preferred amounts range from about 1% to about 60% by weight, more preferably from about 3% to about 50% by weight, of the composition. Depending on formulation constraints, electrolytes such as sodium sulfate may be added to the composition.

Foam stabilizers are an additional component that can be added to the composition. Generally, any foam stabilizer can be used (e.g., amphoterics or anionics) as long as it stabilizes any foam generated by surfactants present in the composition. Preferred foam stabilizers include alkanolamides and amine oxides as well as dioctylsulfosuccinamates. Such foam stabilizers include coconut amides such as ETHOX COA (Piedmont Chemical Industries) or ARMID C (Azko). Preferably, from about 1% to about 30%, more preferably from about 2% to about 6% by weight of the foam stabilizer can be added based on the total weight of the composition.

The next optional component is a fragrance which can be included to mask the odor of the laundry sheets of the present invention and also serve to give the impression to the consumer of freshness. Generally, a sufficient amount of fragrance should only be added to mask the odor of the laundry sheets, and preferably leave a fragrance on the washed clothing. A moderately high molecular weight fragrance which will not appreciably volatilize out of the composition during the production/drying process and which will remain on the clothes to a certain extent is preferred. An example of such a fragrance is perfume oil Downey SUPER 0922 (Value Fragrances, Inc.), or SURF M0513 (Value Fragrances, Inc.), which can be present from about 0% to about 3% by weight of the composition.

A color enhancer can also be included in the composition in small amounts. Preferably, a dye or pigment which imparts a small amount of blue color into the fabrics being washed is preferred. This color enhancer should have solubility properties that permit it to remain level throughout the substrate during the production process without staining fabrics in the washload. A sufficient amount can be included that imparts a slight bluing to the fabrics. A preferred color enhancer is ACID BLUE 145 such as HASTINGS SKY BLUE OB which is an anthraquinone-based dye (Crompton and Knowles). Another preferred colorant is LIQUITINT BLUE HP from Milliken Chemical. A less preferred substitute is ACID BLUE 25, like ALIZARINE BLUE CL (Crompton and Knowles). The color enhancer may be present in an amount from about 0.001% to about 0.5%, more preferably about 0.01 to about 0.025% by weight of the composition. Generally, a dye or pigment which is stable in a highly alkaline environment under high temperatures and for prolonged periods of time is desirable.

Another component that can be present in the composition is a biocide which preserves the composition from attack by microorganisms including bacteria, mildew, and fungus. Preferably, the biocide should be recognized for use in laundry detergents by the United States Environmental Protection Agency, and the biocide should not interact with the surfactant system to minimize the detergency of the surfactants. A preferred biocide is sodium pyrithione, also known as sodium omadine (sodium 2-pyridine thiol-1 -oxide).

Another optional component is a corrosion inhibitor which protects metal surfaces such as zippers, buttons, process equipment, or the inside of washing machines. Preferred corrosion inhibitors include sodium silicate and sodium polysilicate which form a thin inert layer of silicate over the metal surfaces that are susceptible to corrosion. It is preferred that a minimum of about 8 parts per million of sodium silicate or other corrosion inhibitor be present in the wash water. Since sodium silicate is multi-functional and can serve as a builder or a soil anti-redeposition agent, higher levels can be used. In addition to the above preferred corrosion inhibitors, alkanolamides may also serve as corrosion inhibitors. An amount sufficient to prevent the corrosion of metal surfaces should be included and preferred amounts range from about 0% to about 30% by weight, more preferably from about 2% to about 5% by weight based on the total weight of the composition.

The next optional component that can be present is a soil anti-redeposition agent and/or encrustation preventer. Generally, any known soil anti-redeposition agent can be used. Preferably, the soil anti-redeposition agent is a sodium salt of isobutylene/maleic anhydride copolymer such as TAMOL 731A or ACUSOL 460N (Rohm & Haas) or a sodium polymethacrylate such as TAMOL 850. Other examples of sodium polymethacrylates include DARVAN No. 7 (R.T. Vanderbilt Co., Inc.) and DAXAD 30 (Hampshire Chemical Co.). In addition, ACUSOL polymers such as ACUSOL 445 (Rohm & Hans) are designed specifically for laundry applications can be used in concentrations as high as 40% by weight of the composition—ACUSOL 445 is a sodium salt of a polyacrylic acid.

Other optional components of the present composition include processing aids such as dispersing agents, thickeners and stabilizers. Many materials that are useful processing aids are also known in the art to be beneficial as soil antiredeposition aids. For example, high molecular weight polyacrylates which are used as thickeners (e.g. Carbopols—B.F. Goodrich) may also be beneficial for detergency. Materials such as carboxymethylcellulose, hydroxymethylcellulose and polyethylene oxide are known in the art to be thickeners and soil antiredeposition agents. Stabilizers such as ACUSOL 810 and ACUSOL 820 (polyethacrylate copolymers) may be used to allow formulation latitude. For example, ACUSOL 810 and 820 provide the latitude to raise the electrolyte concentration of a slurry which in turn can offer detergency benefits.

Preferred examples include ACUSOL 445ND, 810, 820, 460ND, SOKALAN CP2, SOKALAN CP5 and SOKALAN CP9, and mixtures thereof. When sodium carbonate is included as an optional component in the composition, it is preferred that sufficient amounts of a soil anti-redeposition agent be included to avoid encrustation on the inside of the washing machine. Generally, an amount of the soil anti-redeposition agent is included to prevent soil redeposition and/or encrustation on fabrics. Preferred amounts range from about 0.5% to about 40% by weight, more preferably from about 0.5% to about 4% by weight of the composition.

Another optional component that can be included in the composition is a fabric softener. Generally, any known fabric softener can be included but preferred are quaternary ammonium compounds which have affinity to cellulosic fabrics due to their positive charge and to polyester fabrics due to the presence of an alkyl side chain. An example is a cationic quaternary ammonium compound like a polyethoxylated quaternary ammonium salt.

The quaternary ammonium compound preferably only has one alkyl side chain with approximately 8 to approximately 20 carbon atoms. Further, the quaternary ammonium compound should have one or more polyethoxy or polypropoxy side chains large enough to keep a 1% solution of the quaternary ammonium compound soluble in water at approximately 25° C. Substituents on the nitrogen that are not alkyl side chains from 8 to 20 carbon atoms and are not polyethoxy or polypropoxy side chains may be methyl, ethyl, hydroxymethyl, or hydroxyethyl. Examples include coconut quarternary amine ethoxylate like VARISOFT 910 (Witco Chemical Co.), tallow quarternary amine ethoxylate like VARISOFT 920, PEG-2-cocomonium chloride like VARIQUAT 638 and ETHOQUAD C-12. Preferably, the quaternary fabric softener should form reversible complexes with anionic surfactants and if a mixture of the quaternary fabric softener and the anionic surfactant is sufficiently diluted, the softener and anionic detergent should separate into molecular species. Preferably, from about 1% to about 15% and more preferably from about 2% to about 4% by weight of the fabric softener can be present in the detergent formulation.

Complexes of a ethoxylated amines and ethoxylated sulfonic acids may also be preferably used as antistatic agents and/or fabric softeners. These complexes include STEOL TAAS-2, STEOL TAAS-5, STEOL TAAS-8, and STEOL TAAS-15, which are sold by Stepan Co.

As mentioned, the compositions described above may be applied to a substrate to form a laundry sheet. The substrate can be any substrate known in the art, including, for example, nonwoven and woven fabrics, open-cell rubber or plastic foam sheets, and sheets of cellulose fibers, as long as the substrate is capable of holding the compositions. Examples of substrates can be found in copending U.S. patent application Ser. No. 07/769,391 filed Dec. 19, 1996, the entire contents of which are incorporated herein by the reference. The sheet is preferably a nonwoven fabric. More preferably, the nonwoven fabric sheet is a needlepunched polyester material. It is also preferred that the fabric sheet have a high loft (e.g., a fabric having a basis weight of between about 2 oz/sq. yard to about 6 oz/sq. yard, a mil thickness greater than 40 mils) and fibers fine enough to provide maximum surface area for adhesion of the detergent chemicals and which promote dissolution of the detergent components at the beginning of the wash cycles. The most preferred fabric is a needlepunched polyester produced from 4 denier×4" fibers with a mil thickness of 60 mils and that does not produce lint in the washer or dryer.

In the preferred compositions, the laundry sheet containing the composition is dry to the touch to minimize the transfer of chemicals from the sheet to the user's hands.

Another preferred substrate is a nonwoven fabric that is formed from polyester/rayon fibers and produced by a hydro-entangled process. This fabric sheet may have a thickness of about 15 mils to about 100 mils and a fabric weight of about 2 oz/sq. yard to 6 oz/sq. yard. Further, if the substrate that is used is a polyester or other similar polymer, the sheet can be recycled with other plastic materials such as plastic bottles after being used in a wash cycle. Any nonwoven sheet capable of holding the detergent composition and withstanding the laundering process may be used for this invention. Other fabrics such as spunbonds, powder bonded fabrics, resin bonded fabrics, meltblown fabrics, and thermal bonded fabrics are also useful in this invention. The fabrics can be made of conventional materials, such as acrylics, rayon, cotton, or polypropylene. Preferably, the fabric material should have a melting point above 300° F.

As mentioned, substrates that can be used include open-cell foam rubbers and plastic foams. Urethane foam with a melting point above 300° F. is preferred. Examples of such urethane foams can be found in air filtration products and fabric softener sheets known in the art.

Also, water soluble substrates may also be used so that when the laundry product goes through a wash cycle, the entire product solubilizes leaving no residual product for disposal. These substrates are well known in the art, and include for example, substrates made from polyvinyl alcohols.

Preferably, the compositions described herein are coated onto or impregnated into the substrate by any means known to those skilled in the art. For example, the compositions can be applied to the substrate by means of a water slurry, from a melt, or from a solvent system.

Application of a slurry to the substrate may occur using any device which forces the slurry into the substrate or allows the slurry to flow into the substrate. Examples of application equipment include standard coating equipment, slot applicators, various types of printing equipment, padding equipment, and spraying equipment. The substrate is then carried by a supporting device through a drying device and processed into sheets or wound into rolls. Examples of supporting devices include rollers, belts, and clip and pin frames.

The fabric is unrolled and fed into an on-the-frame knife coater such as a MASCOE 4TC where it is drawn under the coating applicator and over a foam rubber pad. The slurry is held in a trough just in front of the coating knife and is applied to the fabric as it passes underneath. The slurry is both impregnated into and coated onto the fabric in such a way that the coating is fiber reinforced thus reducing the tendency for sloughing off of the compound in downstream handling. The slurry is applied to achieve from 26 to 42 ounces per square yard of wet coating.

Process controls and equipment for fabric conveyance, for fabric guidance and for controlling fabric dimensional characteristics (e.g overfeed, tension, and creasing) should be used as necessary to convey the fabric in a flat and open position under a coating head and through drying, slitting and batching equipment. The fabric is conveyed between a vinyl covered foam pad and a coating trough. Depending on the viscosity of the detergent composition, the curvature of the coating blade, and the frame speed, various process parameters may be adjusted to achieve penetration of the coating through the fabric and the desired wet add on. For example the coating blade may be raised to produce a bigger gap between the foam pad and the coating blade. The depth of compound in the coating trough may be increased to increase the downward pressure of the compound into the fabric. The width of the slot which allows the slurry to meet the fabric may be adjusted, as well as the density of the foam pad. The viscosity of the compound may be lowered by raising the temperature of the slurry.

The substrate can be dried using vacuum extraction, or any type of radiant energy with wavelength longer than ultra violet, or using convection drying. For example, infrared preheaters with a gas fired forced air oven can be used. The fabric is then cut into swatches that allow for the proper amount of the composition to be delivered to the laundry.

In making the compositions, the components can simply be stirred together to produce a homogeneous slurry. Any order of addition is possible if acidic materials are diluted and preneutralized. Once the slurry is formed, in order to apply the slurry to the substrate to make a laundry sheet of the present invention, the slurry is pumped into a coating trough or other application device and impregnated or applied into or on the substrate, preferably a low denier, high loft nonwoven fabric sheet. The substrate is supported in a horizontal and flat position while the water is evaporated from the substrate. The substrate can then be cut into desired shapes and sizes and placed in a box for use by the consumer. The compositions set forth in Table 2 below are preferred because these slurries can be coated and dried on a tenter frame without causing excessive contamination to the winding, coating, and drying equipment. Further, these particular compositions, upon being applied to the substrate are dry to touch and thus do not get the user's hands wet with detergent. It is preferred that the substrate or sheet be a needle punched fabric, but spun laced fabric or foam sheets can also be used.

The laundry product having a substrate may additionally provide cleaning, whitening, brightening, and freshening to laundered articles in the washing machine. The preferred compositions applied to the substrate readily solubilize off the substrate during the washing process.

It is preferred that the above additional components as well as the primary surfactants and nonionic surfactants have a small particle size range. A small particle size range makes it easier for the composition to be applied or impregnated onto the substrate. The particle size range is preferably less than about 200 microns, and more preferably from about 0.1 microns to about 10 microns for each component that is present in the composition.

Set forth below is a table providing a listing of preferred ingredients for the composition with preferred ranges and most preferred ranges based on weight percents of the entire preferred detergent composition. Such compositions are suitable for application to a substrate sheet.

TABLE 1

| Component | Preferred Range (Wt. Percent) | Most Preferred Range (Wt. Percent) |
|---|---|---|
| Water | Balance | Balance |
| SYLOJET P 405 | 0.5–30 | 1.5–10 |
| ACUSOL 810 | 0–40 | 0.2–4 |
| ACUSOL 820 | 0–40 | 0.2–4 |
| Soda Ash | 0–60 | 2.5–10 |
| DOWFAX Detergent Solution | 0–95 | 15–25 |
| HASTINGS SKY BLUE OB | 0–0.5 | 0.01–0.2 |
| Sodium Omadine (40%) | 0–0.2 | 0.05–0.08 |

TABLE 1-continued

| Component | Preferred Range (Wt. Percent) | Most Preferred Range (Wt. Percent) |
|---|---|---|
| BIO-SOFT Preblend | 0–95 | 5–20 |
| Burcowite BTA - Conc. | 0–20 | 0–5 |
| TERGITOL TMN-6 | 0–40 | 0–2 |
| TERGITOL 15-S-9 | 0–40 | 0–2 |
| NEODOL 25-9 | 0–40 | 5–15 |
| ETHOX COA | 0–30 | 2.6 |
| Downey SUPER 0922 | 0–5 | 0.3–0.7 |
| STEOL TAAS-8 | 0.5–30 | 1–5 |
| TAMOL 850 | 0–40 | 0–5 |
| VALFOR 100 | 0–60 | 0–2.5 |
| Sodium Sulfate | 0–60 | 2.5–10 |
| ACUSOL 460 ND | 0–80 | 0.2–4 |
| ACUSOL 445 ND | 0–80 | 0.5–4 |
| Silicate E | 0–30 | 2–5 |
| Ground NEOBOR (Borax 5 mol) | 0–50 | 10–20 |

It is preferred to apply the compositions to the substrate from a water slurry. However, applying the compositions from a melt or from a nonaqueous solvent is also possible.

Preferred compositions used in the water slurry application are shown in the following Table:

TABLE 2

| INGREDIENT | FORMULA 1 (Wt %) | FORMULA 2 (Wt %) | FORMULA 3 (Wt %) |
|---|---|---|---|
| Cold Water | 16.028 | 22.52 | 22.52 |
| Soda Ash | 3.75 | 3.75 | 3.75 |
| DOWFAX Detergent Solution | 15.2 | 13.82 | 13.82 |
| BIOSOFT Preblend | 15.2 | 13.82 | 13.82 |
| 7% HASTINGS SKY BLUE OB | 0.162 | 0.14 | 0.14 |
| TERGITOL TMN-6 | 0.95 | 0.86 | 0.86 |
| VALFOR 100 | 2 | 2 | 2 |
| SYLOJET P405 | 1.9 | 2.7 | — |
| SYLOX 2 | — | — | 2.7 |
| BURCOWITE BTA-Conc. | 2 | 1.8 | 1.8 |
| Sodium Omadine | 0.07 | 0.06 | 0.06 |
| STEOL TAAS-8 (5% IPA) | 3 | 2.6 | 2.6 |
| NEODOL 25-g | 9.025 | 8.21 | 8.21 |
| Downey SUPER 0922 | 0.475 | 11.43 | 0.43 |
| ETHOX COA | 1.9 | 1.72 | 1.72 |
| Silicate E SKY BLUE | 1.9 | 1.72 | 1.72 |
| NEOBOR (Borax 5 Mol) Granular | 20.55 | 18.5 | 18.5 |
| ACUSOL 445 N (45% solution of Acusol 445ND) | 2.09 | 1.9 | 1.9 |
| ACUSOL 460 N (25% solution of Acusol 460ND or Tamol 731) | 3.8 | 3.45 | 3.45 |
| Special Prooessing | Pass through high shear IKA mill to achieve an average particle size of 6.5 microns | Pass through high shear IKA mill to achieve an average particle size of 6.5 microns | Pass through high shear IKA mill to achieve an average particle size of 6.5 microns |

Tables 3 and 4 below show preferred compositions used when forming the composition as a melt.

TABLE 3

| INGREDIENT | FORMULA 4 | FORMULA 5 | FORMULA 6 | FORMULA 7 | FORMULA 8 | FORMULA 9 |
|---|---|---|---|---|---|---|
| ALPHA-STEP XMP-60 Flake | 40 | — | — | — | — | — |
| ALPHA-STEP MC48 | — | 15 | 5 | 10 | — | — |

TABLE 3-continued

| INGREDIENT | FORMULA 4 | FORMULA 5 | FORMULA 6 | FORMULA 7 | FORMULA 8 | FORMULA 9 |
|---|---|---|---|---|---|---|
| Agent X-MC4870S | — | — | — | — | — | 20 |
| NEODOL 45-13 | 40 | 54 | 64 | 63 | 68 | 48 |
| BURCOWITE BTA | 4 | 4 | 4 | — | — | — |
| BTA TINOPAL 5BMGX (ground) | — | — | — | 0.8 | 1 | 1 |
| 7% HASTINGS SKY BLUE OB | 0.3 | — | — | — | — | — |
| STEOL TAAS8/IPA | 6 | 6 | 6 | 6 | 6 | 6 |
| Downey Fragrance | 1 | 1 | 1 | 1 | 1 | 1 |
| Sodium Omadine | 0.1 | — | — | — | — | — |
| Sodium Acetate | 3 | 10 | 10 | 9.2 | — | — |
| Sodium Citrate | — | — | — | — | 10 | 10 |
| SYLOJET P403 or P405 | 7 | 7.5 | 7.5 | 10 | 10 | 10 |
| SAVINASE 8.0T | — | — | — | — | 4 | 4 |

TABLE 4

| INGREDIENT | FORMULA 10 | FORMULA 11 | FORMULA 12 | FORMULA 13 | FORMULA 14 | FORMULA 15 | FORMULA 16 |
|---|---|---|---|---|---|---|---|
| NEODOL 45-13 | 40 | 66 | 56 | 61 | 56 | 43 | 56 |
| NINOL 96-SL | — | — | — | — | 10 | 10 | 10 |
| ALPHA-STOP BSN-50 | 30 | — | — | — | | | |
| TINOPAL 5BMGX (ground) | 1 | 1 | 1 | 1 | 1 | 1 | 1 |
| ACUSOL 445ND | — | — | — | 5 | — | — | — |
| STEOL TAAS 8/IPA | 6 | 6 | 6 | 6 | 6 | 6 | 6 |
| Downey Fragrance | 1 | 1 | 1 | 1 | 1 | 1 | 1 |
| Sodium Acetate | 10 | 10 | 10 | 10 | 10 | 10 | 10 |
| SYLOJET P403 or P 405 | 8 | 8 | 8 | 8 | 8 | 8 | 8 |
| ALCALASE | 4 | 4 | 4 | 4 | 4 | 4 | — |
| SAVINASE 8.0T | — | — | — | — | — | — | 4 |
| Sodium Perborate Monohydrate | — | — | — | — | — | 10 | — |
| BURCO ACTIVATOR SP | — | — | — | — | — | 3 | — |
| TERGITOL TMN-6 | — | 4 | 4 | 4 | 4 | 4 | 4 |
| STEOL CS-370 | — | — | 10 | — | — | — | — |

The compositions above can be coated onto a fabric, or extruded and made into patties or cast into prills. Compositions of Table 4 may be made by melting the NEODOL 45-13 and raising it to around 40° C. The powdered ingredients such as the TINOPAL 5BMGX (optical brightener—acid form) and the sodium acetate (builder and solubility aid) should be ground into fine powders before addition to the formulation. It is desirable to include anionic surfactants and/or polymers to prevent soil redeposition. Since those polymers and anionic surfactants generally do not melt, they may be added to the formulation as finely separated dry matter with application of enough shear to finely disperse the materials throughout the composition. One should add enzymes and bleaches shortly before the composition is cooled in its final form to minimize the degrading effect of heat on these ingredients. Sodium percarbonate is desirable as a bleach instead of sodium perborate if careful selection of ingredients allows processing temperatures to be kept low enough to prevent loss of activity. In some cases it may be cheaper or it may facilitate processing to add some ingredients which contain minimal quantities of water. If ingredients containing water are added to these melt formulations, they should be added at the end of the composition shortly before processing into the final product form. This order of addition should minimize any degrading effect of water on enzymes and bleaches.

Besides the addition of ionizable acid salts to aid in dispersion/solution of the composition, the inclusion of alcohol ethoxylates with pour points below the expected end use temperature is desirable (e.g., a pour point below the wash water temperature) to further increase rapid dispersion of the detergent throughout the washing machine. While primary alcohol ethoxylates with low pour points are desirable, secondary alcohol ethoxylates (e.g., TERGITOL 15-S-9) are even more desirable for promoting rapid dispersion of the detergent in the washing machine. Most preferable for promoting dispersion/solution of the formula in the washing machine is the inclusion of branched secondary alcohol ethoxylates such as TERGITOL TMN-6. It is important to pay close attention to the solubility of the composition as the higher molecular weight nonionic surfactants and the inclusion of the SYLOJET may lessen the compositions' solubility.

The amount of the composition on a substrate which has the size of approximately 6"×6.5" is preferably at least 2 grams. A more preferred amount is at least 12 grams per 6"×6.5" substrate. Of course, this amount can be adjusted to any desired amount. An even more preferred amount is from about 14 grams to about 24 grams per 6"×6.5" substrate.

The components listed in the above tables may be added to the substrate to form a laundry sheet wherein the ratio of each component on a dry basis in the composition is 0.5–30 wt % silica gel, 0–60 wt % of at least one builder, 5–95 wt % of at least one surfactant, 0–60 wt % of at least one soil redeposition agent, 0–5 wt % of at least one foam stabilizer, 0–1 wt % of at least one color enhancer, 0–5 wt % of at least one optical brightener, and 0–0.5 wt % of at least one biocide. Preferably, the composition present on the substrate contains, on a dry basis, 1.5–10 wt % of silica gel, 1–95 wt % of at least one builder, 1–95 wt % of at least one surfactant, 1–5 wt % of at least one soil redeposition agent, 1–5 wt % of at least one foam stabilizer, 0.01–0.05 wt % of at least one color enhancer, 0.1–1 wt % of at least one optical brightener, and 0.01–0.05 wt % of at least one biocide.

An example that is illustrative of a process for producing the laundry sheet of the claimed invention is as follows.

EXAMPLE 1

To form a detergent composition, the following components were combined in the order shown. The soda ash was first completely dissolved in the cold water, and the subsequent components were added at a temperature maintained below 30° C.

TABLE 5

| INGREDIENT | FORMULA 1 (wt %) |
|---|---|
| Cold Water | 16.028 |
| Soda Ash | 3.75 |
| DOWFAX Detergent Solution | 15.2 |
| ACUSOL 460 N (25% solution of Acusol 460ND or Tamol 731) | 3.8 |
| NEOBOR (Borax 5 Mol) Granular | 20.55 |
| BIOSOFT Preblend | 15.2 |
| 7% HASTINGS SKY BLUE OB | 0.162 |
| Sodium Omadine | 0.07 |
| BURCOWITE BTA-Conc. | 2 |
| TERGITOL TMN-6 | 0.95 |
| STEOL TAAS-8 | 3 |
| VALFOR 100 | 2 |
| SYLOJET P405 | 1.9 |
| Water | 2.903 |
| NEODOL 25-9 | 9.025 |
| Downey SUPER 0922 | 0.475 |
| ETHOX COA | 1.9 |
| Silicate E | 1.9 |
| ACUSOL 445 N (45% solution of Acusol 445ND) | 2.09 |

The characteristics of the composition were preferably maintained within the following limits, with the observed values reported in the third column:

| Test | Range | Observed Value |
|---|---|---|
| pH (1%) | 8–11 | 9.33 |
| Solids (oven) | 47–60 wt % | 56.67 |
| Density | 0.9–1.25 | 0.952 |
| Brookfield Viscosity | 3,000–12000 cps | 8700 |
| Appearance | blue, viscous liquid | |

The slurry was then moved to the finishing facility to be applied to a fabric that was sufficiently strong to allow processing and have durability to laundering. A needlepunched polyester fabric produced from 4 denier×4" fiber; to produce a 50 to 300 mil thick substrate. Other types of fabrics or substrates with a surface area and void volume similar to this fabric would produce an acceptable product. The fabric was held on both selvages by the pin chain of the tenter frame and stretched 10% in the cross-direction. The coated fabric was then passed underneath infrared predryers before drying in a gas-fired convection oven at 275–450 degrees Fahrenheit. The product was then cooled with cool air, trimmed and rolled up for shipment. The finished product conformed to the following specifications:

| | |
|---|---|
| Basis weight overall | 16.15–25.5 OSY |
| Dry add-on | 13.75–23.1 OSY |
| Thickness | 0.060" |
| Width | 60" |
| Wash durability | OK to 1MW and dry |
| Fragrance | Present after laundering |
| Moisture content | <10% |

EXAMPLE 2

NEODOL 25-9, Downey SUPER 0922, STEOL TAAS-8 (5% IPA) and SYLOJET P405 were added to a dry vessel in the listed order at a temperature maintained above 80° F. The contents of the vessel were stirred to blend the SYLOJET P405, which initially floated on top, into the mixture. The mixture was stirred with maximum shear without trapping air into the mixture. Stirring was continued until a sample of the mixture showed no evidence of lumps. The resulting first mixture had the following composition:

TABLE 6

| INGREDIENT | Wt. PERCENT |
|---|---|
| NEODOL 25-9 | 62.7 |
| Downey SUPER 0922 | 3.3 |
| STEOL TAAS-8 (5% IPA) | 20.8 |
| SYLOJET P405 | 13.2 |

In a separate vessel, milled soda ash was dissolved in cold water with constant circulation of the water and stirring. DOWFAX Detergent Solution, ACUSOL 460N (a 25 wt % solution of ACUSOL 460ND or TAMOL 731), and granular NEOBOR (Borax 5 moles) were added to the vessel to form a slurry. The slurry was circulated through a high shear IKA mill until the slurry felt smooth when rubbed between the finger and the thumb. After adding the NEOBOR, the contents were vigorously stirred to prevent gelling.

While stirring the slurry, TERGITOL TMN-6, 7% HASTINGS SKY BLUE OB, BIOSOFT Preblend, concentrated BURCOWHITE BTA, sodium omadine, and VALFOR 100 were added. Once the VALFOR 100 was incorporated into the slurry, the first mixture containing NEODOL 25-9, Downey Super 0922, STEOL TAAS-8 (5% IPA) and SYLOJET P405 was added. ETHOX COA was then added. The temperature of the slurry at this point was about 50 ° C. Silicate E was added at a temperature slightly warmer than 50° C. to avoid the formation of lumps in the slurry. Stirring speed was increased when the slurry was observed to thicken. ACUSOL 445 N (a 45% solution of ACUSOL 445 ND) was added with continued stirring, and water was added as necessary to rinse the sides of the vessel or stirring blades, to adjust the viscosity of the slurry, or to help disperse the VALFOR 100.

The ratio of each ingredient in the resulting composition is shown below:

TABLE 7

| INGREDIENT | Wt % |
|---|---|
| Cold Water | 13.05 |
| Soda Ash | 3.75 |
| DOWFAX Detergent Solution | 15.2 |
| ACUSOL 460 N (25% solution of ACUSOL 460ND or TAMOL 731) | 3.8 |
| NEOBOR (Borax 5 Mol) Granular | 20.55 |
| TERGITOL TMN-6 | 0.95 |
| 7% HASTINGS SKY BLUE OB | 0.14 |
| BIOSOFT Preblend | 15.2 |
| BURCOWITE BTA-Conc. | 2 |
| Sodium Omadine | 0.07 |
| VALFOR 100 | 2 |
| First Mixture (See Table 5) | 14.4 |
| ETHOX COA | 1.9 |
| Silicate E | 1.9 |
| TERGITOL TMN-6 | 20.55 |
| ACUSOL 445 N (45% solution of Acusol 445ND) | 2.09 |
| Additional Water | 3 |

The resulting composition was applied to a substrate in a manner similar to that of Example 1.

As a result of the present invention, a laundry sheet can be made which contains a predetermined dose of detergent chemicals to provide convenience to consumers. In addition, the product in the test load should show little or no static cling, and the sheet should shed little or no fiber into the test load. Preferably the laundry sheet is a concentrated product with as many multifunctional ingredients as possible. For example, the following ingredients can provide multiple functions.

TABLE 8

| INGREDIENT | FUNCTIONS |
|---|---|
| Sodium Aluminosilicate | Builder, Water Softener, Contributes to Dry Hand |
| Soda Ash | Builder, Water Softener, Contributes to Dry Hand, Raises pH for Better Polar Soil Detergency (Alkali Source) |
| Polyacrylates | Soil Anti-Redeposition Agents, Dispersant, Organic Builder |
| Coconut Amine concentrates | Improves Detergency, Produces Foam (Esthetically Pleasing) |
| HASTINGS SKY BLUE OB | Colors Coating, Optical Brightening |
| Sodium Silicate | Corrosion Inhibition, Builder, Water Softener, Dry Hand |
| Tertiary Amine Complex | Antistatic Agent, Fabric Softener |

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A laundry sheet comprising a substrate and a detergent composition wherein the composition which is added to the substrate comprises:

about 0.5 to about 30 weight percent of water insoluble silica gel particles, wherein the average size of a silica gel particle is 3 to about 20 microns;

about 5 to about 95 weight percent of at least one surfactant;

about 1 to about 60 weight percent of a builder, and about 0.5 to 40 weight percent of at least one soil anti-redeposition agent, wherein said silica gel has an internal porosity as measured by oil absorption of about 300 to about 330 pounds per 100 pounds of the silica gel.

2. The laundry sheet of claim 1, wherein the silica gel has a surface area of about 150 to about 450 $m^2/g$.

3. The laundry sheet of claim 1, wherein the silica gel has a pore volume of about 1.5 to about 2.5 cc/g.

4. The laundry sheet of claim 1, wherein the silica gel is present in admixture with a solid, water-soluble ionizable material.

5. The laundry sheet of claim 1, wherein the composition contains 1–95 wt % of at least one builder, 5–40 wt % of at least one surfactant, 0.5–4 wt % of at least one soil anti-redeposition agent, 0–5 wt % of at least one foam stabilizer, 0–1 wt % of at least one color enhancer, 0–1 wt % of at least one optical brightener, and 0–0.5 wt % of at least one biocide.

6. The laundry sheet of claim 1, further comprising a complexing agent, optical brightener, alkaline source to raise pH, electrolyte, foam stabilizer, color enhancer, colorant, biocide, corrosion inhibitor, soil anti-redeposition agent, encrustation preventor, oxidizing agent, or an enzyme, or any combination thereof.

7. The laundry sheet of claim 1, wherein said surfactant is a nonionic surfactant.

8. The laundry sheet of claim 1, wherein said surfactant is an anionic surfactant.

9. The laundry sheet of claim 1, wherein said surfactant is an amphoteric surfactant.

10. The laundry sheet of claim 1, wherein said surfactant is an alcohol ethoxy sulfate, a linear alkyl benzene sulfonate, an alcohol sulfate, a sodium or potassium salt of a long chain fatty acid, a secondary alkane sulfonate, an α-olefin sulfonate, a cocoamphocarboxylpropionate, or a methylester sulfonate, or any combination thereof.

11. The laundry sheet of claim 1, wherein said surfactant is at least one nonionic surfactant and at least one anionic surfactant.

12. The laundry sheet of claim 1, wherein said surfactant is an alcohol ethoxylate, an alkylphenol ethoxylate, an ethyleneoxide/propyleneoxide block copolymer, an alkyl polyglycoside, an alkanolamide, an amine ethoxylate, or an amine oxide.

13. The laundry sheet of claim 1, wherein the surfactant is an alkylated sulfonated diphenyl oxide disodium salt or a tetrasodium N-(1,2-dicarboxymethyl)-N-octadecyl sulfosuccinamate.

14. The laundry sheet of claim 1, wherein said builder includes one or more of the following: a borate, a phosphate, a polyphosphate, a zeolite, a silicate, a carbonate, a citrate, an ethylenediaminetetracetate, and a nitrilotriacetate.

15. The laundry sheet of claim 1, comprising a substrate which is a nonwoven sheet.

16. The laundry sheet of claim 15, wherein said substrate is a polyester, nylon, urethane or polypropylene.

17. The laundry sheet of claim 15, wherein said substrate is a needle punch fabric.

* * * * *